US010662027B2

(12) United States Patent
Sonnenmoser et al.

(10) Patent No.: US 10,662,027 B2
(45) Date of Patent: May 26, 2020

(54) METHOD FOR OPERATING AN ELECTRONIC SAFETY SYSTEM WITH TEMPORARY PARTICIPANTS

(71) Applicant: Inventio AG, Hergiswil (CH)

(72) Inventors: Astrid Sonnenmoser, Hochdorf (CH); Ivo Lustenberger, Buttisholz (CH); Martin Hess, Baar (CH)

(73) Assignee: INVENTIO AG, Hergiswil NW (CH)

( * ) Notice: Subject to any disclaimer, the term of this patent is extended or adjusted under 35 U.S.C. 154(b) by 368 days.

(21) Appl. No.: 15/536,815

(22) PCT Filed: Dec. 15, 2015

(86) PCT No.: PCT/EP2015/079751
§ 371 (c)(1),
(2) Date: Jun. 16, 2017

(87) PCT Pub. No.: WO2016/096829
PCT Pub. Date: Jun. 23, 2016

(65) Prior Publication Data

US 2017/0355559 A1 Dec. 14, 2017

(30) Foreign Application Priority Data

Dec. 18, 2014 (EP) ..... 14199058

(51) Int. Cl.
*B66B 5/00* (2006.01)
*B66B 1/34* (2006.01)
*B66B 13/22* (2006.01)

(52) U.S. Cl.
CPC ..... *B66B 5/0031* (2013.01); *B66B 1/3415* (2013.01); *B66B 13/22* (2013.01)

(58) Field of Classification Search
CPC ..... B66B 5/0031; B66B 1/3415; B66B 13/22
USPC ..... 187/393
See application file for complete search history.

(56) References Cited

U.S. PATENT DOCUMENTS 5,257,176 A * 10/1993 Uetani ..... B66B 1/3407 700/83
6,173,814 B1 * 1/2001 Herkel ..... B66B 1/34 187/248
7,849,975 B2 * 12/2010 Ketonen ..... B66B 13/22 187/316

(Continued)

FOREIGN PATENT DOCUMENTS

CN 103068710 A 4/2013
EP 1159218 A1 12/2001

(Continued)

*Primary Examiner* — David S Warren
(74) *Attorney, Agent, or Firm* — William J. Clemens; Shumaker, Loop & Kendrick, LLP

(57) ABSTRACT

A method for operating a safety system having a control unit, a bus, a plurality of bus nodes connected to the control unit via the bus, and a plurality of participants connected to the control unit via the bus nodes, wherein at least one participant is designated as a temporary participant. The method includes the step of logging the temporary participant out of the safety system by giving notice of a disconnection of the temporary participant from the safety system by a manipulation and disconnecting the temporary participant from the safety system. The safety system can be used with an elevator system for carrying out the method.

9 Claims, 3 Drawing Sheets

(56) References Cited

U.S. PATENT DOCUMENTS

| | | | | |
|---|---|---|---|---|
| 9,776,829 | B2 * | 10/2017 | Kattainen | B66B 13/22 |
| 9,802,790 | B2 * | 10/2017 | Kattainen | B66B 13/22 |
| 10,214,383 | B2 * | 2/2019 | Sonnenmoser | B66B 5/0031 |
| 10,214,384 | B2 * | 2/2019 | Sonnenmoser | B66B 5/0031 |
| 2015/0053507 | A1 * | 2/2015 | Kattainen | B66B 5/00 187/288 |
| 2015/0053508 | A1 * | 2/2015 | Kattainen | B66B 13/22 187/289 |
| 2015/0075917 | A1 * | 3/2015 | Kattainen | B66B 5/00 187/288 |
| 2016/0280509 | A1 * | 9/2016 | Sonnenmoser | B66B 5/0031 |
| 2017/0341905 | A1 * | 11/2017 | Sonnenmoser | B66B 13/22 |
| 2017/0349404 | A1 * | 12/2017 | Sonnenmoser | B66B 5/02 |
| 2017/0355559 | A1 * | 12/2017 | Sonnenmoser | B66B 5/0031 |
| 2018/0179021 | A1 * | 6/2018 | Uchida | B66B 1/28 |

FOREIGN PATENT DOCUMENTS

| | | | |
|---|---|---|---|
| WO | 0051929 | A1 | 9/2000 |
| WO | 201009740 | A1 | 9/2010 |
| WO | 2013020806 | A1 | 2/2013 |
| WO | 2014048826 | A1 | 4/2014 |

* cited by examiner

5a TARGET LIST

| ADD | ID1 | ID2 | Description | W | N |
|---|---|---|---|---|---|
| 41 | SS | AAA | Shaft door (61) floor 1 | A | A |
| 42 | SS | BBB | Shaft door (62) floor 2 | A | A |
| 43 | SS | CCC | Shaft door (63) floor 3 | A | A |
| 44 | TT | DDD | Elevator car door (74) | A | A |
| 45 | UU | EEE | Safety Brake (75) | A | A |
| 46 | VV | FFF | Emergency switch (76) | A | A |
| 47 | WW | GGG | Brake (87) | A | A |
| 48 | XX | HHH | Speed (88) | A | A |
| 49 | YY | III | Temporary participant (89) | A | I |

Fig. 2

METHOD FOR OPERATING AN ELECTRONIC SAFETY SYSTEM WITH TEMPORARY PARTICIPANTS

FIELD

The invention relates to a method for operating a safety system with temporary participants and to a safety system provided to carry out said method, and to an elevator system having said safety system.

BACKGROUND

Elevator systems are provided with safety systems for safe operation. Said safety systems typically consist of safety elements connected in series. Said safety elements can for example monitor the condition of shaft doors or elevator car doors. Electromechanical safety circuits or else bus-based safety circuits are known for this. The safe operation of such bus-based safety circuits is checked regularly. The structure and testing methods of such bus-based safety circuits are known for example from EP 1159218 A1, WO 2010/097404 A1 or WO 2013/020806 A1. However, it is not clear from this prior art whether or to what extent safety is ensured when temporary participants, such as a manual control device for controlling the elevator system during maintenance or an input device in which configuration settings of the safety system can be set, are connected and disconnected.

SUMMARY

An object of the invention is therefore to specify a method, a safety system and an elevator system having such a safety system, with which safe disconnection of a temporary participant from the safety system is ensured.

The safety system of the elevator system comprises a control unit, a bus, a plurality of bus nodes, which are connected to the control unit via the bus, and a plurality of participants, which are connected to the control unit via a bus node.

A control unit in this case means a unit that at least has a microprocessor, a working memory and a non-volatile memory. Such a control unit is therefore designed to execute computer-supported programs. The control unit is in this case configured as a safety control unit that monitors safety-relevant conditions of the elevator system and, if an unsafe condition occurs, returns the elevator system to a safe condition. This includes for example monitoring the shaft door conditions, the elevator system being stopped if a shaft door is open.

Participants in this case mean sensors, switch contacts, operating elements or actuators, which on the one hand monitor a condition of the elevator system and on the other hand can influence the safe operation of the elevator system. These include position sensors, speed sensors or acceleration sensors, which monitor a movement condition of an elevator car, and also switch contacts, which monitor the condition of a shaft door or elevator car door or the passing of a predefined end position by the elevator car. A safety system can also comprise operating elements, by means of which control commands for controlling the safety system or the elevator system, for configuring the safety system or for selecting an operating mode can be input, such as a button, an input screen or a manual control device. Actuators mean all components that can be actuated by the control unit to return an elevator system to a safe condition after an impermissible condition has been established, such as a drive motor, a holding brake or a safety brake. This list of the above-mentioned participants is only by way of example and is not exhaustive.

The safety system can have at least one participant that is designed as a temporary participant. A temporary participant in this case means a participant that is connected to the safety system or the control unit via a bus node only temporarily. Such temporary participants can be designed for example as operating elements, governor elements or bridging elements, which are connected or should be connected to the safety system only in a certain operating mode, such as a normal operating mode, a maintenance mode or a configuration mode.

Manual control device in this case means a device for controlling the elevator system that is operated by a maintenance technician during maintenance work. This manual control device preferably comprises four control elements, namely a button for executing a downwardly or upwardly directed movement, a button for triggering an emergency stop, and a switch for activating and deactivating the maintenance mode.

The temporary participant is preferably logged out of the safety system by A) giving notice of a disconnection of the temporary participant from the safety system by means of a manipulation of the safety system, and B) disconnecting the temporary participant from the safety system.

By means of the manipulation of the safety system, an expectation is created in the control unit, which expectation can be used for monitoring the logging out process of a corresponding temporary participant. This manipulation can take place for example via a switch element of a manual control device or via a touch-sensitive screen of an input device.

The manipulation preferably takes place by inputting a control command at an input point provided therefor or by operating a switch. The input point or the switch are each connected to the safety system.

The safety system is preferably set to a fault mode by the control unit if the temporary participant is not disconnected from the safety system until after a predefined time after the manipulation of the safety system. This ensures that the logging out process of the temporary participant is an action carried out deliberately.

Fault mode in this case means a mode in which the elevator system can be operated only to a limited extent or not at all. When in fault mode, the elevator system is generally stopped so that a potentially dangerous situation cannot arise. At most, it would be possible in fault mode to permit a last movement of the elevator car to the nearest floor to avoid trapping passengers in the elevator car. The elevator system can then be put back into operation when the situation that resulted in the fault mode has been rectified. If, for example, the temporary participant is not disconnected from the safety system until after a predefined time, the temporary participant must be connected to the safety system again.

A target list of the participants is preferably implemented on the control unit, which list includes at least data on an identification number of each participant, and the temporary participant is logged out of the control unit by the control unit changing an entry of the temporary participant in the target list from an active status to an inactive status.

The identification number is a number by means of which a participant connected to the safety system can be identified; in particular, said number can be an identification number that is unique for each participant or an identification number that states a type of the participant. The identification number can be stored on a storage medium of the participant. Such an identification number can also be stored in advance on the target list. The target list defines an expectation of the control unit of which participants should be connected to the safety system. Accordingly, there is an entry in the target list for each participant that can be connected to the safety system. If the temporary participant is disconnected from the safety system, said participant is set to inactive in the target list or in the entry thereof by the control unit.

An actual list of the participants is preferably implemented on the control unit, said list forming an image of the participants connected to the safety system, and operation of the elevator system is only enabled if the control unit establishes a correspondence in a comparison between the participants activated in the target list and the participants entered in the actual list.

The actual list is a list of all the participants connected to the safety system at a certain point in time. All the detected participants are preferably listed in the actual list using their identification numbers. The comparison between the participants listed in the actual list and the participants stored in the target list, in particular those that have an active status for a certain operating mode, is preferably performed on the basis of the identification numbers listed in the two lists. This comparison ensures that all the participants provided for a certain operating mode are connected to the safety system before a corresponding operating mode is enabled.

In the event of a power failure, a system condition of the safety system is preferably stored in a non-volatile memory of the control unit; in particular the system condition is stored using a target list.

When the safety system is put back into operation after the power failure, the stored system condition is preferably compared with the current system condition by the control unit; in particular the stored target list is compared with an updated actual list and the safety system is set by the control unit to a fault mode if a temporary participant is found to be missing from the actual list on the basis of the comparison.

A further aspect of the invention relates to a device for carrying out the method and an elevator system having said device.

DESCRIPTION OF THE DRAWINGS

The invention is described in more detail below using exemplary embodiments. In the figures:

FIG. 2 shows an exemplary embodiment of a target list that is implemented on the control unit of the safety system.

DETAILED DESCRIPTION

Figure 1:
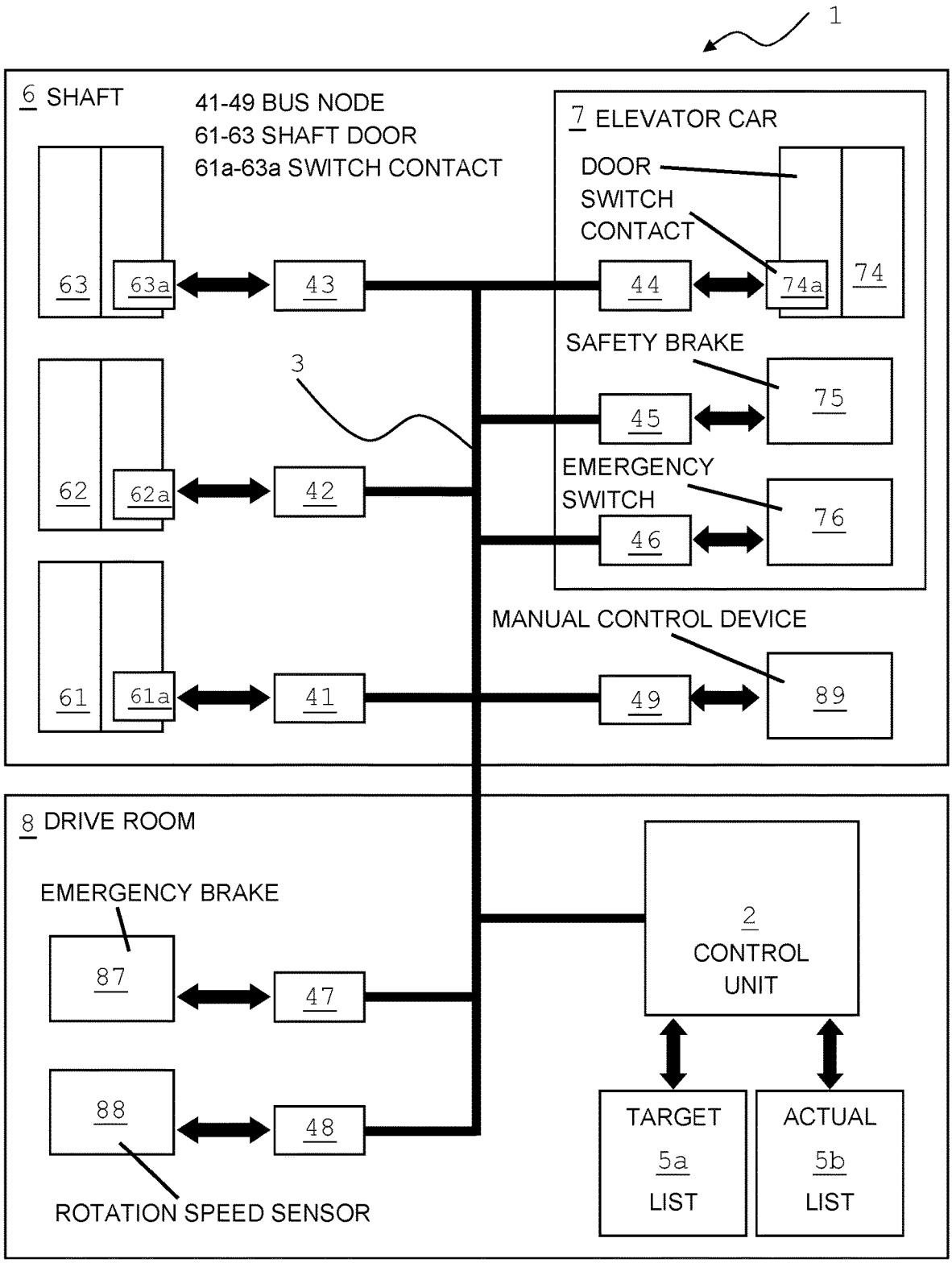
FIG. 1 schematically shows an exemplary arrangement of an elevator system according to the invention.

The elevator system 1 shown schematically in FIG. 1 comprises a control unit 2, which is connected to a plurality of bus nodes 41 to 49 via a bus 3. The control unit 2 can be arranged in a separate drive room 8, as shown in FIG. 1. In a preferred embodiment, the control unit 2 can also be arranged in a shaft 6.

Reference sign 6 schematically indicates a shaft 6 of a building in which the elevator system 1 is installed. The building has, by way of example, three floors, each floor being equipped with a shaft door 61, 62 and 63, respectively. The bus node 41 is assigned the shaft door 61, the bus node 42 is assigned the shaft door 62 and the bus node 43 is assigned the shaft door 63.

The respective bus node 41, 42, or 43 is assigned a participant, in this case for example a switch contact 61*a*, 62*a*, 63*a*, which detects information relating to the condition of the associated shaft door 61, 62 or 63 (open, closed, locked) and can generate a fault signal for the control unit 2 if necessary.

The elevator system 1 also has an elevator car 7. The elevator car 7 is equipped with an elevator door 74, which is likewise assigned to a bus node 44. The bus node 44 is assigned a further participant, for example a further switch contact 74*a*, which determines information relating to the condition of the associated elevator door 74 (open, closed, locked) and can generate a fault signal for the control unit 2 if necessary.

The elevator system 1 can also have a bus node 45 and a bus node 46, which are assigned further participants, namely a safety brake 75 arranged on the elevator car 7 and an emergency switch 76, respectively. The safety brake 75 is used for safety-braking the elevator car 7, for example if said car reaches an excessive speed. The elevator system 1 can be brought to an immediate standstill in an emergency situation by operating the emergency switch 76.

Also, a drive unit is arranged in a drive room 8, which drive unit is equipped with two further participants, namely with an emergency brake 87 and with a rotation speed sensor 88, which are assigned a bus node 47 and 48 respectively. In a preferred embodiment, the drive unit can be arranged in the shaft 6, omitting a separate drive room.

Furthermore, a bus node 49 is provided, which is arranged in the region of the shaft 6 and is designed to receive a temporary participant, namely a manual control device 89. The bus node 49 can be arranged in particular on the roof of the car 7 or in the bottom of the shaft 1 or at one of the doors 61-63, depending on the point of the elevator system 1 at which maintenance work that requires the elevator car 7 to be moved is to be carried out. The temporary participant 89 is therefore connected to the bus 3 or the control unit 2 via the bus node 49.

In the example shown, the temporary participant 89 can be connected to the bus 3 at a slot of the corresponding bus node 49. Alternatively, the temporary participant 89 can also be connected to bus 3 wirelessly, for example via a WLAN, Bluetooth or other type of radio connection.

The manual control device 89 is designed to control the elevator system 1 and the elevator car 7 during a maintenance mode and comprises for example four control elements, namely a button for executing an upwardly or downwardly directed movement, a button for triggering an emergency stop and a switch for activating and deactivating a maintenance mode.

The control unit 2 has a target list 5*a*, which defines an expectation of the control unit 2. The target list 5*a* comprises e.g. a list of which of the participants 61*a*-63*a*, 74*a*, 75, 76, 87, 88, 89 should be connected to the bus 3 at a certain point in time. In addition, the control unit 2 has an actual list 5*b*, which is a list of all the participants 61*a*-63*a*, 74*a*, 75, 76, 87, 88, 89 currently connected to the bus 3.

The target list 5*a* is explained in more detail using FIG. 2. The target list 5*a* comprises an entry for each participant contained therein. This entry corresponds to one row of the table. In a first column is stored a bus address ADD of a bus node 41 to 49 at which the respective participant 61*a*-63*a*,

74*a*, 75, 76, 87, 88, 89 is connected. The control unit 2 can communicate with a bus node 41 to 49 and a participant 61*a*-63*a*, 74*a*, 75, 76, 87, 88, 89 connected thereto via the bus address ADD. The control unit 2 can correspondingly address control signals to a corresponding participant, for example to the safety brake 75 via the bus address ADD, 45, or request conditions of the switch contact 61*a* in a targeted manner from the bus address ADD, 41.

In a second column is stored a first identification number ID1 of a participant 61*a*-63*a*, 74*a*, 75, 76, 87, 88, 89. This first identification number ID1 is dependent on the type of participant. For instance, the participants 61*a* to 63*a* all have the same first identification number ID1 with the value SS, since all three participants are in the form of switch contacts 61*a* to 63*a* of identical type, which monitor the condition of an associated shaft door 61 to 63. A safety brake 75, however, has a different first identification number ID1 with the value UU.

The participants can also be identified by means of a second identification number ID2. This second identification number ID2 is for example a number AAA to JJJ for each participant 61*a*-63*a*, 74*a*, 75, 76, 87, 88, 89, which number permits unambiguous identification of each participant 61*a*-63*a*, 74*a*, 75, 76, 87, 88, 89.

Finally, an activation value A or I is stored for each participant in the target list 5*a*, the activation value A representing an active status of a participant and the activation value I representing an inactive status. The target list 5*a* shown has activation values A, I for two different operating modes of the elevator system 1, namely for a normal operating mode N and for a maintenance mode W. For instance, in the entry for the temporary participant 89 or the manual control device, an activation value A is given for a maintenance mode W and an activation value I is given for a normal operating mode N. The manual control device 89 is therefore assigned an active status in the maintenance mode W and an inactive status in the normal operating mode N.

Figure 3:
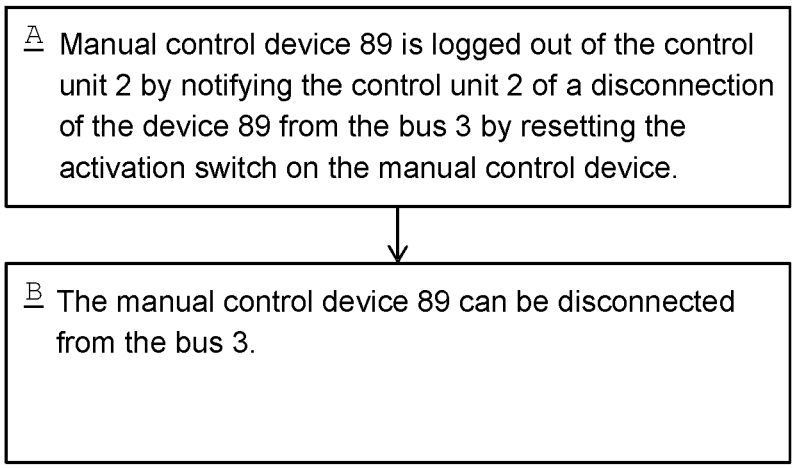
FIG. 3 shows a flow chart of an exemplary sequence of a logging out process of a temporary participant in the safety system.

After maintenance work has finished, the manual control device 89 is logged out of the control unit 2 by, in a first step A according to FIG. 3, notifying the control unit 2 of a disconnection of the manual control device 89 from the bus 3 by resetting the activation switch on the manual control device. After the activation switch has been reset, the manual control device 89 can be disconnected from the bus 3 in a second step B. By resetting the activation switch, an expectation is created in the control unit 2, which expectation can be used for monitoring the logging out process of the manual control device 89.

In this case, the elevator system 1 is preferably set to a fault mode by the control unit 2 if the temporary participant 89 is not disconnected from the bus 3 until after a predefined time after the activation switch is reset.

Alternatively, notice can be given of the disconnection of the temporary participant 89 by means of a manipulation on the control unit 2. The notification can be made by inputting a control command at an input point provided therefor, which is connected to the bus 3 via a bus node or is arranged directly on the control unit 2. A further possible way of giving notice of the disconnection is by operating a switch. This switch can likewise be connected to the bus 3 via a bus node or be arranged directly on the control unit 2.

When the manual control device 89 is logged out, its entry in the target list 5*a* is set by the control unit 2 from an active status A to an inactive status I. In correspondence with the operating mode W, N stored for the inactive status I for the manual control device 89 in the entry in the target list 5*a*, the control unit 2 can automatically put the elevator system 1 into a normal operating mode N.

In addition, an actual list 5*b* of the participants 61*a*-63*a*, 74*a*, 75, 76, 87, 88, 89 is implemented on the control unit 2, which list forms an image of the participants 61*a*-63*a*, 74*a*, 75, 76, 87, 88, 89 connected to the safety system at a certain point in time. The actual list 5*b* has a very similar structure to the target list 5*a* and comprises substantially the first four columns of the target list 5*a*. The control unit 2 therefore reads out the participant 61*a*-63*a*, 74*a*, 75, 76, 87, 88, 89 connected to the respective bus node 41 to 49 for each bus node 41 to 49 present or the address ADD thereof and the identification numbers ID1, ID2. Operation of the elevator system 1 is only enabled by the control unit 2 if the control unit 2 establishes a correspondence in a comparison between the identification numbers ID1, ID2, in particular the identification numbers ID1, ID2 of the entries in the target list 5*a* for which an active status is stored in a respective operating mode N, W, and those of the actual list 5*b*.

In the event of a power failure, the system condition of the elevator system 1 is stored in a non-volatile memory of the control unit 2. In particular, the target list 5*a* is stored in the non-volatile memory, since the target list 5*a* represents such a system condition. This is because all the participants 61*a*-63*a*, 74*a*, 75, 76, 87, 88, 89 that should have an active status at a certain point in time are listed in the target list 5*a*.

When the elevator system 1 is put into operation again after the power failure, the stored target list 5*a* acts as a check-list. The stored target list 5*a* is compared with the current actual list 5*b* to establish whether all the temporary participants 89 present before the power failure are still connected to the bus 3. If the control unit 2 finds on the basis of the comparison that a temporary participant 89 is missing from the actual list, the control unit sets the elevator system 1 to a fault mode.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for operating a safety system of an elevator system having a control unit, a bus, a plurality of bus nodes connected to the control unit via the bus, and a plurality of participants, of which at least one of the participants is designed as a temporary participant, connected to the control unit via the bus nodes, comprising the steps of:

logging the at least one temporary participant out of the safety system by,

A) giving notice to the control unit of a disconnection of the at least one temporary participant from the safety system by a manipulation of the safety system; and B) disconnecting the temporary participant from the safety system.

2. The method according to claim 1 including setting the safety system to a fault mode by the control unit if the at least one temporary participant is not disconnected from the safety system until after a predefined time after the manipulation of the safety system.

3. The method according to claim 1 including implementing a target list of the participants on the control unit, the target list including at least data on an identification number of each of the participants, and wherein the at least one temporary participant is logged out of the safety system by the control unit changing an entry of the at least one temporary participant in the target list from an active status to an inactive status.

4. The method according to claim 3 including implementing an actual list of the participants on the control unit, the actual list forming an image of the participants connected to the safety system, and wherein operation of the elevator system is only enabled if the control unit establishes a correspondence in a comparison between the participants activated in the target list and the participants in the actual list.

5. The method according to claim 1 including the manipulation of the safety system by inputting a control command at an input point or by operating a switch, wherein the input point and the switch are each connected to the safety system.

6. The method according to claim 1 wherein in an event of a power failure, a system condition of the safety system is stored in a non-volatile memory of the control unit using the target list.

7. The method according to claim 6 wherein when the safety system is put back into operation after the power failure, the stored system condition is compared with a current system condition as an actual list of the participants connected to the safety system by the control unit, and the safety system is set by the control unit to a fault mode if the at least one temporary participant is found to be missing from the actual list on the basis of the comparison.

8. A safety system for an elevator system having a control unit, a bus, a plurality of bus nodes connected to the control unit via the bus, and a plurality of participants, of which at least one participant is designed as a temporary participant, connected to the control unit via the bus nodes, wherein the safety system is configured to perform the method according to claim 1.

9. An elevator system having the safety system according to claim 8.

* * * * *